US008528603B2

(12) United States Patent
DeMik

(10) Patent No.: US 8,528,603 B2
(45) Date of Patent: Sep. 10, 2013

(54) TIE GUIDE CHANNEL FOR CABLE TIE INSTALLATION TOOL

(75) Inventor: Jonathan A. DeMik, St. John, IN (US)

(73) Assignee: Panduit Corp., Tinley Park, IL (US)

( * ) Notice: Subject to any disclaimer, the term of this patent is extended or adjusted under 35 U.S.C. 154(b) by 1439 days.

(21) Appl. No.: 11/859,475

(22) Filed: Sep. 21, 2007

(65) Prior Publication Data

US 2009/0078331 A1 Mar. 26, 2009

(51) Int. Cl.
*B21F 9/02* (2006.01)
*B21F 33/00* (2006.01)
*B65B 13/24* (2006.01)

(52) U.S. Cl.
USPC ..... 140/93.2; 140/57; 100/29

(58) Field of Classification Search
USPC ..... 140/57, 118, 119, 93.2, 93 A; 100/29, 100/32, 33 R
See application file for complete search history.

(56) References Cited

U.S. PATENT DOCUMENTS 4,004,618 A 1/1977 Turek
4,498,506 A 2/1985 Moody et al.
5,042,535 A 8/1991 Schlottke
5,205,328 A 4/1993 Johnson et al.
5,417,252 A 5/1995 Kurmis
5,595,220 A * 1/1997 Leban et al. ..... 140/123.6
5,722,466 A 3/1998 Levin et al.
5,769,133 A 6/1998 Dyer et al.
5,845,681 A 12/1998 Kurmis
6,981,528 B2 1/2006 Bartholomew

* cited by examiner

*Primary Examiner* — Teresa M Ekiert
(74) *Attorney, Agent, or Firm* — Christopher S. Clancy; Aimee E. McVady

(57) ABSTRACT

An improved cable tie installation tool includes a fixed cable tie guide channel mechanism that assists in retention of cable tie heads in a cable bundling position and prevents "bounce back" of the cable tie head back into the guide channel. The fixed guide channel mechanism is located near the distal end of the guide channel and includes a ramped surface and a retention wall oriented substantially perpendicular to the guide channel. The fixed guide channel mechanism is located on a side opposite a jaw assembly and may be combined with a biased retractable retainer assembly located on a wall opposite the guide channel mechanism. The fixed guide channel mechanism can serve as a primary system, a back-up to the retractable retainer assembly, or used in combination with the retractable retainer assembly. In embodiments, the guide channel mechanism may form an integral part of the guide channel or may be a separate insert affixed to the channel.

17 Claims, 7 Drawing Sheets

TIE GUIDE CHANNEL FOR CABLE TIE INSTALLATION TOOL

BACKGROUND

The present invention relates generally to a tool for the automatic installation of a cable tie around a bundle of wires and, more specifically, to a guide channel for such a tool that improves cable tie feed to avoid cable tie jams resulting from bounce back.

A wide variety of cable tie application tools are known. Some provide individual cable ties from a remote dispenser having a cartridge or reel containing a large number of cable ties to a conveyance mechanism for provision to the application tool.

One special type of cable tie application tool has used the application of pressurized air to convey the individual cable ties from the dispenser to a hand manipulated application tool at very high rates of speed, propelling cable ties to a cable tie tool head at up to 50-80 MPH, for application to a bundle of wires. Examples include U.S. Pat. No. 3,946,769 to Caveney et al., U.S. Pat. No. 4,004,618 to Turek, U.S. Pat. No. 4,498,506 to Moody et al., and U.S. Pat. No. 5,722,466 to Levin et al. Tools based on these patents are also commercially available from Panduit Corporation and marketed under the tradenames PAT1M for use with cable bundles up to about 0.82", PAT1.5M for bundles up to about 1.31", and PAT2S for bundles up to 2" in diameter.

These remote dispenser cable tie installation tools are very desirable and have been highly successful for situations where maximum volume and speed of application is necessary. However, due to the very high operating rates of speed, cable tie jams within the guide channel of the tool or incomplete cable tie attachment occasionally occur, which may result in extensive delays and repair costs that can be very significant. In particular, as the feed rates increase, forces acting on the fed cable tie as it is rapidly stopped by a head stop assembly can cause a tendency for the cable tie to "bounce back" in a rearward direction from the head stop assembly back towards the guide channel.

Certain existing models of cable tie application tools include a guide channel mechanism that assists travel of the cable tie through the channel and may resist some "bounce back." The mechanism includes use of two biased side members or a single biased, pivotal lower guide surface. Examples of these are shown in U.S. Pat. No. 4,498,506 to Moody et al., U.S. Pat. No. 4,004,618 to Turek, and U.S. Pat. No. 5,845,681 to Kurmis. Such tools were intended for low dispense speeds. However, with certain tools requiring higher dispense feed rates, secure retention of the cable tie head becomes problematic because the biased guide members may not respond quick enough to fully prevent "bounce back."

SUMMARY

It is an object of the present invention to provide an improved cable tie installation tool having a fixed cable tie guide channel mechanism that assists in retention of cable tie heads in a cable bundling position and prevents bounce back of the cable tie head back into the guide channel.

It is another object of the present invention to provide an improved cable tie installation tool having a cable tie channel mechanism that provides a backup or redundant guide structure that resists cable tie bounce back.

It is a further object of the present invention to provide a cable tie guide channel mechanism for a cable tie installation tool that does not suffer problems with reaction speed so that reliability at high delivery speed rates can be achieved.

In certain embodiments, the cable tie guide channel mechanism is in the form of a replacement insert. In other embodiments, the cable tie guide channel mechanism is an integral part of the channel.

In various embodiments, the guide channel includes a biased pivotal guide surface facing one side of the guide channel and a fixed guide channel mechanism including a fixed ramp surface opposite the biased pivotal guide surface. The fixed ramp surface includes a retaining wall substantially perpendicular to the guide channel and facing a distal end thereof. The ramped surface guides one-way entry of the cable tie into the cable tool head through the guide channel, while the biased pivotal guide surface sizes the channel to receive the cable tie therethrough. Upon the cable tie passing the guide channel section, the biased pivotal guide surface is biased upward to restrict the guide channel size and engage a retaining wall of the pivotal guide surface with a rear of the cable tie head. The retaining wall surface on the fixed ramp also restricts rearward movement of the cable tie head by engaging a top rear surface of the head, regardless of whether the pivotal guide surface has fully retracted.

In certain embodiments, the cable tie guide channel mechanism operates as a back-up or complement system to a biased head retainer mechanism that acts to restrict the size of the cable channel upon passing of the cable tie head. In other embodiments, the fixed guide channel mechanism may be a standalone component when provided on a side opposite the jaw assembly. However, improved cable tie head retention and blockage may be achieved when both the fixed and movable retaining walls cooperatively engage both the top and bottom rear surfaces of the cable tie head simultaneously.

In accordance with certain aspects, the biased head retainer mechanism may form a bottom retention wall that blocks rearward movement of a bottom of a cable tie head while the cable tie guide channel mechanism forms a top retention wall that blocks rearward movement of a top of the cable tie head. The combination of these two mechanisms support both the top and bottom of the cable tie head to resist or restrain rearward movement of the cable tie head into tile channel.

In an exemplary embodiment, a cable tie installation tool automatically accepts a reel of cable ties mounted on a strip. The tool sequentially separates each cable tie from the reel and conveys the discrete cable tie to a remote installation tool at a high speed by pneumatic action where the cable tie is automatically installed around a bundle of wire or the like, tensioned at a predetermined value, and the tail severed and ejected. Each cable tie abuts a cable tie head stop to position the cable tie in a cable bundling position and is blocked from bounce back by a cable tie guide channel mechanism.

DETAILED DESCRIPTION OF EMBODIMENTS

Figure 1:
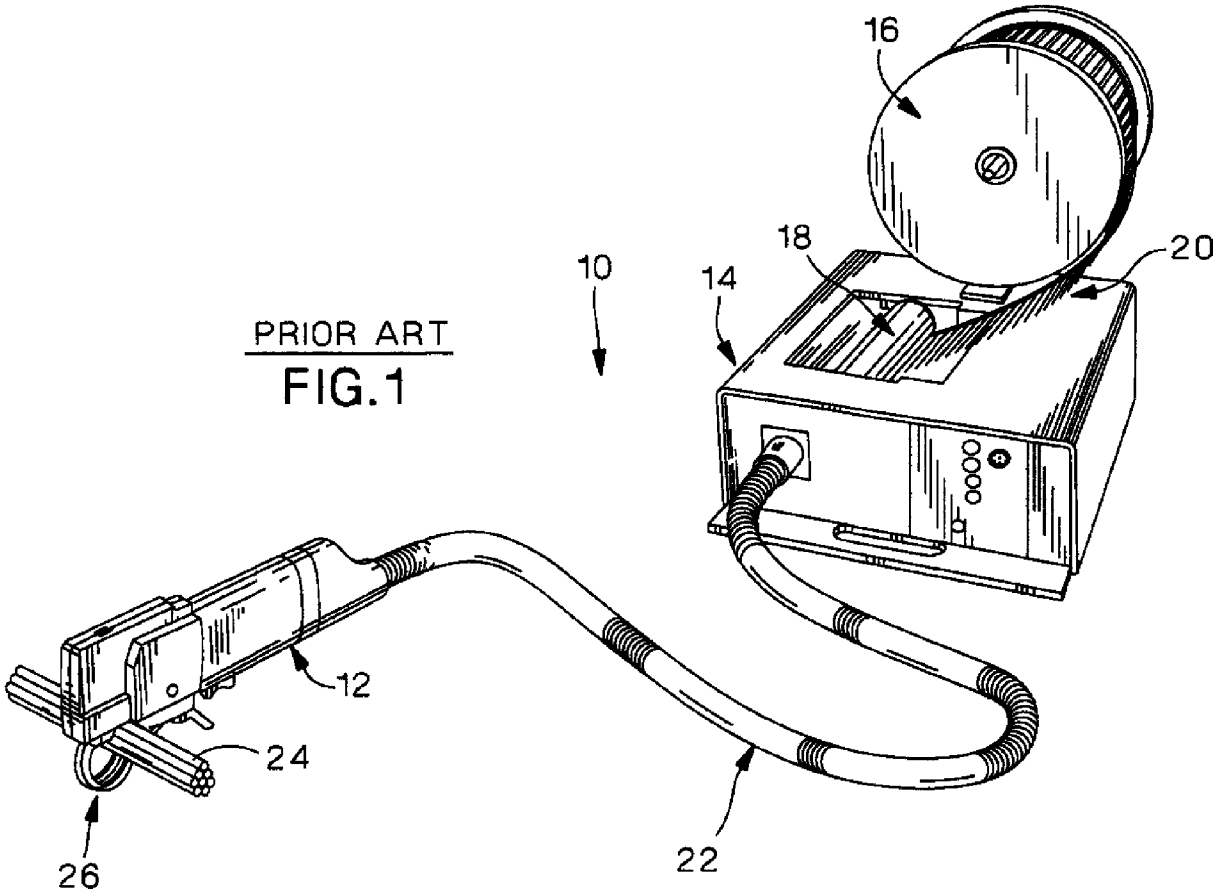
PRIOR ART FIG. 1
FIG. 1 is a perspective view of an exemplary automatic cable tie application tool to which the tie guide channel can be provided.

A remote dispenser type cable tie application tool system using the application of pressurized air to convey individual cable ties to the hand manipulated tool is designated generally by the reference numeral 10 in the accompanying drawings.

As shown in FIG. 1, a cable tie application tool system 10 includes a cable tie application tool 12, and a cable tie dispenser 14 connected to the tool 12 via a transfer tube 22. The dispenser 14 is connected to a cable tie reel 16 and receives the individual cable ties 20 through a receiving drum 18. The drum 18 of the dispenser 14 receives and positions the individual cable ties 20 for transfer into and through the transfer tube 22 into position within the application tool 12 for application by the tool jaws 26 around a bundle of wires 24. Additional details on the general operation of the cable tie installation tool can be found in U.S. Pat. No. 4,498,506 to Moody et al. and U.S. Pat. No. 4,004,618 to Turek, and U.S. Pat. No. 5,722,466 to Levin et al., the disclosures of which are hereby incorporated herein by reference in their entireties.

During a normal cycle of advancing a cable tie through the tube 22 to tool 12, when the user activates the trigger, a primary air burst is sent to move the loaded tie 20 through a cable tie passageway in tube 20 where it is advanced partway into the tube. The primary air blast is stopped to allow for the loading of the next cable tie 20 into position. A secondary air burst pushes the first cable tie 20 through the tube 22 and into a guide channel 30 of the tool 12 (FIG. 2) where it is advanced toward a cable tie bundling position where the head of cable tie 20 is to be positioned opposite an opening 55 (FIG. 3). At this position, the cable tie free end becomes encircled around a bundle and is suitably tensioned. Then, the free end is severed and ejected.

Figure 2:
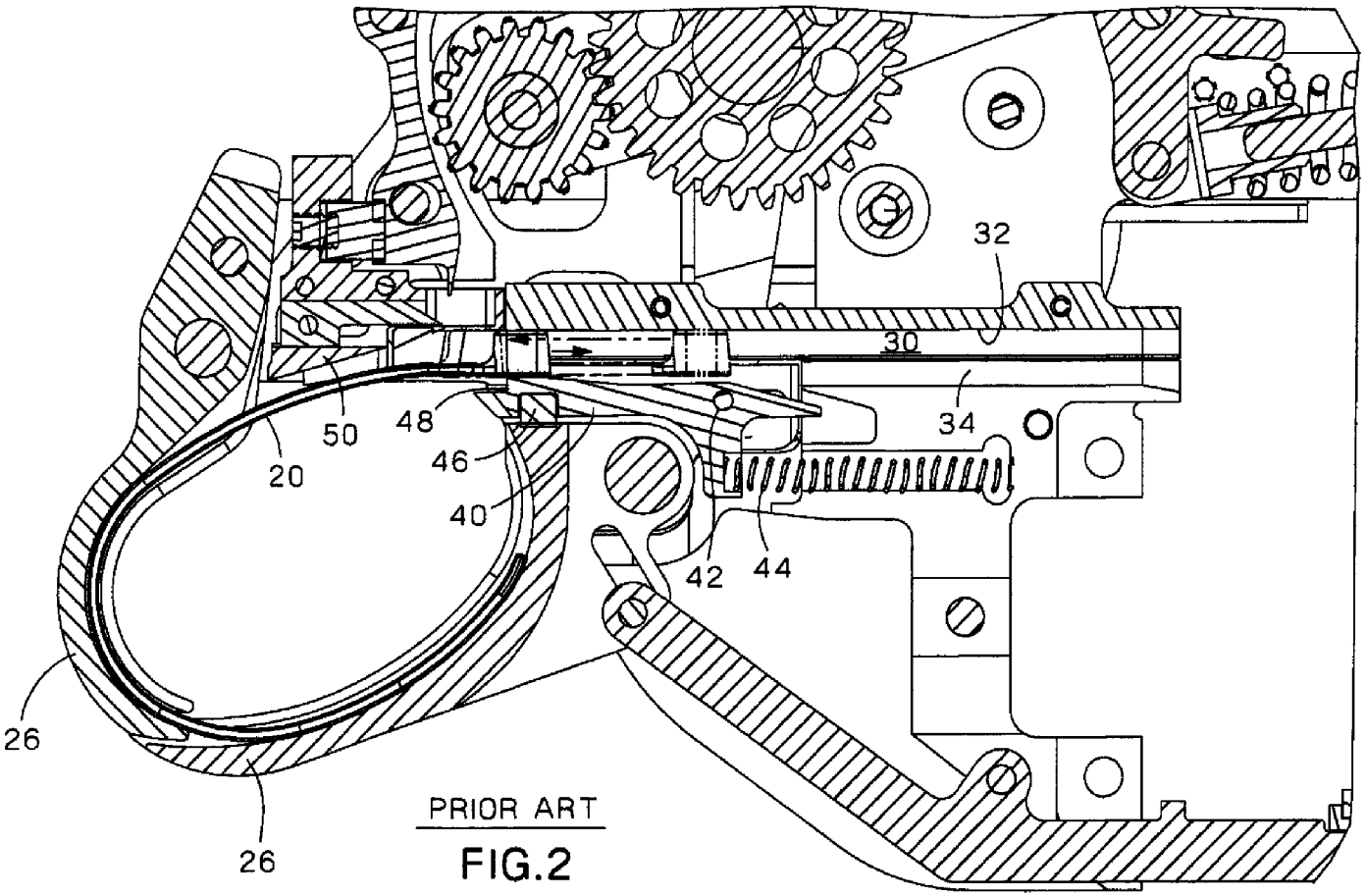
PRIOR ART FIG.2
FIG. 2 is a partial cross-sectional view of the interior of a prior art cable tie installation tool showing a cable tie guide channel having a cable tie fed therethrough.
Figure 3:
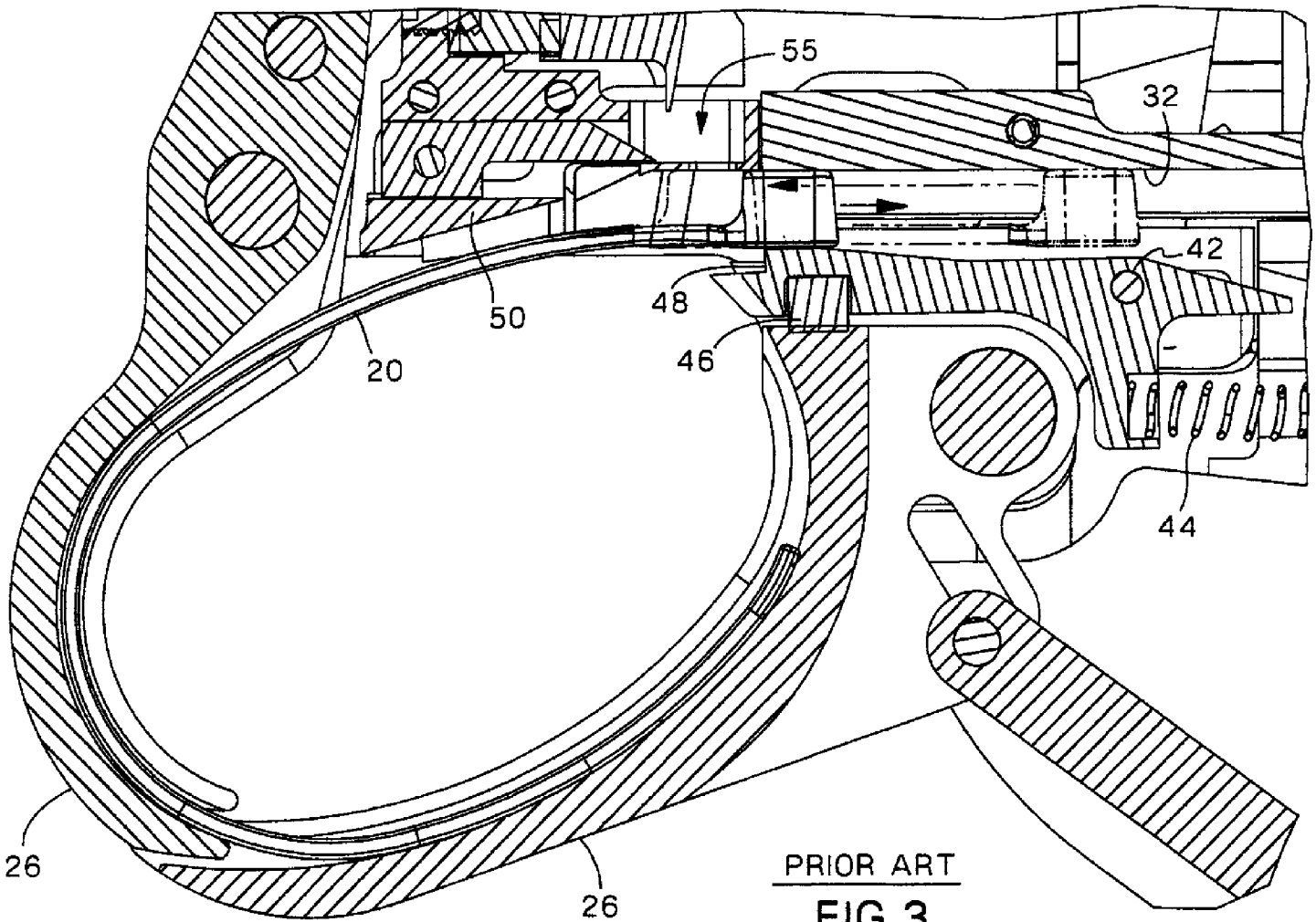
PRIOR ART FIG.3
FIG. 3 is a partial cross-sectional view of the prior art tool of FIG. 2 showing possible bounce back jamming.

As better shown in FIG. 2, a conventional cable tie application tool 12 includes a guide channel 30 comprising a top wall 32 and a lower wall 34 that define the channel therebetween sized to allow guided passage of cable ties 20. A biased head retainer assembly 40 is provided in certain models and is intended to bias upwards upon passing of the cable tie head 20 so as to narrow the entrance size of the guide channel 30 and engage the bottom of the cable tie head to prevent bounce back. A typical biased head retainer assembly 40 includes a main body pivotally attached to a pivot pin 42 and biased by a spring 44 to a position that extends the main body into the channel 30. A damper 46 and a notched retainer wall 48 may also be provided. In use, as the cable tie 20 is passed through the channel 30 over the main body, the cable tie 20 overcomes the bias and allows the main body to pivot to enlarge the size of channel 30. However, upon passing of the cable tie head 20 beyond the retainer assembly 40, a properly working main body will spring upward into channel 30 so that the retainer wall 48 extends sufficiently into the channel to engage the bottom edge of the cable tie head (FIG. 3). This restrains backwards movement of the cable tie to resist reentering back into the cable tie channel 30 due to forces acting on the head during contact with head stopper assembly 50.

However, due to tile high speeds of delivery and limitations in the reaction speed of assembly 40, particularly as it slows with age or usage, it is sometimes difficult for the head retainer assembly 40 to respond quick enough to catch the cable tie head 20. For example, if the head retainer wall 48 does not respond quickly enough or becomes caught oil the bottom of the cable tie head 20, the stiffness of the cable tie body can cause the cable tie 20 to retreat back into the tie guide channel 30 as illustrated in FIG. 2. This will improperly align the cable tie head and prevent proper mating of the cable tie free end through the cable tie head opening 55. Moreover, this improper positioning will likely jam the machine and prevent proper ejection and feeding of subsequent cable ties without operator intervention.

Figure 4:
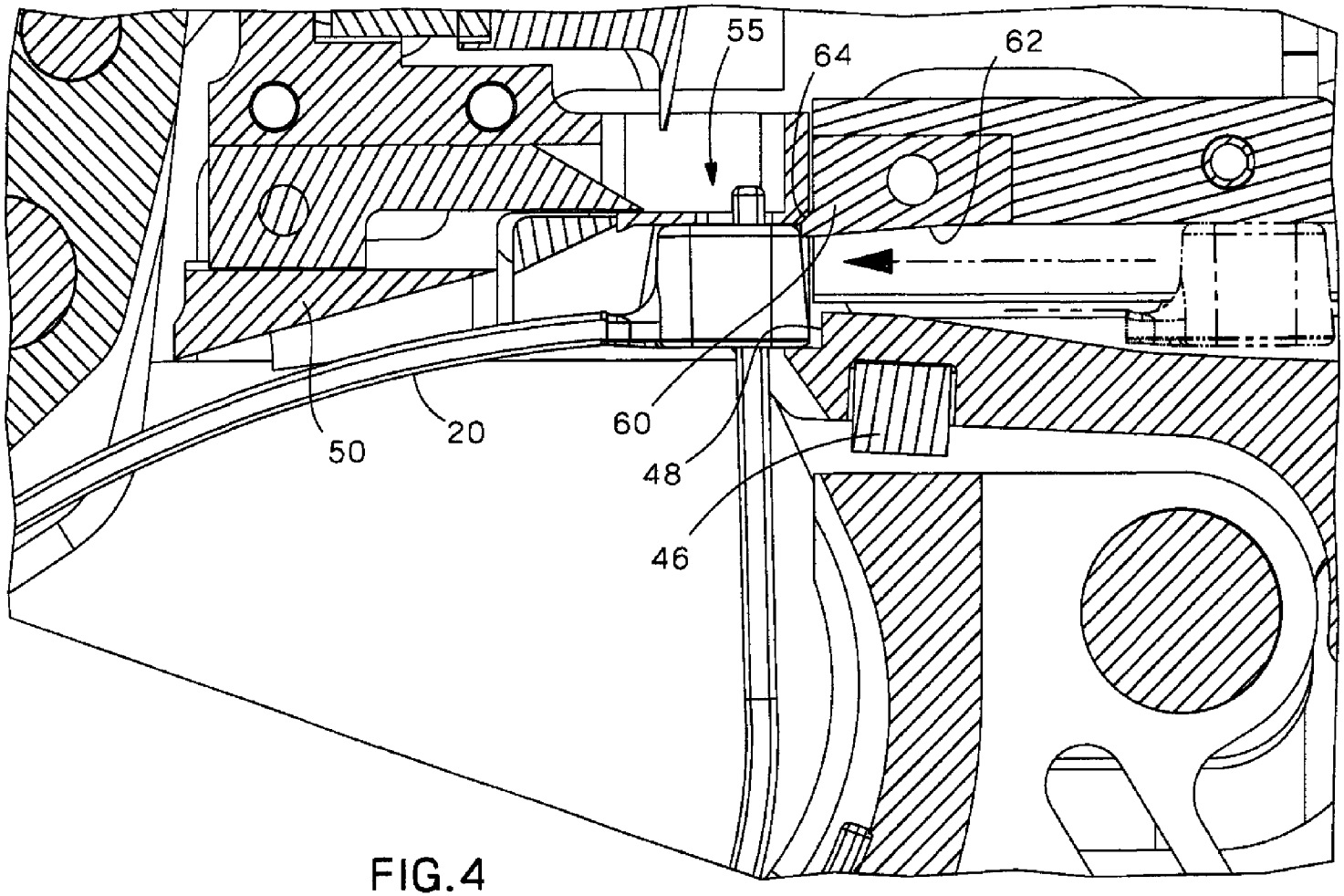
FIG. 4 is a partial cross-sectional view of an exemplary tool according to a first embodiment.
Figure 5:
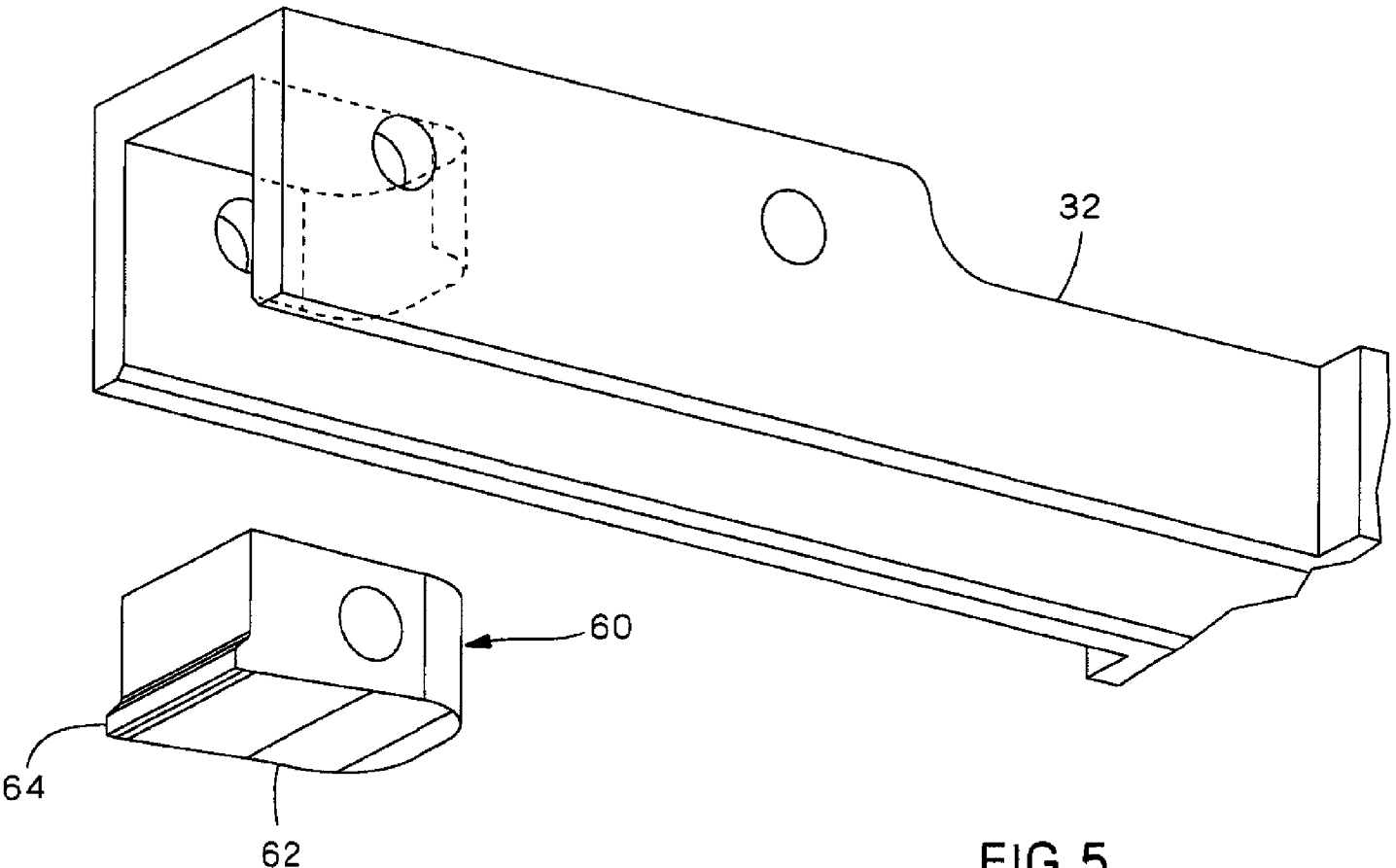
FIG. 5 is a partial perspective view of the tool of FIG. 4 showing the cable guide channel mechanism in the form of a removable or replaceable insert.

FIGS. 4-5 illustrate a first embodiment of a cable tie application tool with an improved guide channel mechanism that improves blocking of "bounce back" and thus improves tool reliability to address problems with "bounce back." The tool is similar to that shown in FIGS. 1-3, but adds an additional guide channel mechanism 60 on tile top of the guide channel 30 near the distal end of the channel.

In the illustrative embodiment, guide channel mechanism 60 is in the form of a removable insert that can be fitted to a distal end of the guide channel 30 by conventional means, such as a pin, dovetail, or press-fit connection. FIG. 5 shows an exemplary embodiment in which the mechanism 60 is fitted by a pin (unshown) through the illustrated openings. Insert 60 includes a ramped surface 62 that ramps inward into the guide channel 30 to restrict the size of channel 30 towards the distal end. Insert 60 also includes a retention wall 64 near or at the far distal end of the insert oriented substantially perpendicular to channel 30. The insert dimensions are sized depending on the particular tool and cable tie to allow entry of the cable tie therethrough in a forward direction with minimal interference. while retention wall 64 is of a sufficient height to solidly engage a rear surface of cable tie head 20 to restrain "bounce back" into the channel 30. In the illustrated embodiment, a biased cable tie head retainer assembly 40 is provided opposite the insert to provide a retractable guide surface that can be urged downward by the force of the entering cable tie to effectively increase the channel size to allow passage of the cable tie therethrough in the forward direction.

During positioning of the cable tie into its cable tie bundling position, the resilient, but semi-stiff cable tie becomes wrapped around jaws 26, which apply a compressive force upon the cable tie urging it from a straight to a wrapped state that encircles a bundle. Upon contact of the cable tie head with the cable tie head stop 50 (FIG. 4), forces on the cable tie due to the abrupt stop against stop 50 and properties of the cable tie may cause "bounce back," particularly when delivery speeds are high. During such "bounce back", the cable tie due to its resiliency attempts to restore itself to its previous straight state as it travels rearward towards channel 30. As a result, the cable tie head 20 will be urged rearward and outward towards the wall of channel 30 opposite tile jaws. In the illustrated example where the jaws are facing downward, this is the top surface of channel 30. Accordingly, in this embodiment, the insert 60 is provided on the top side of channel 30. However, if the jaws were located elsewhere, the insert location would accordingly change.

Because insert 60 is a fixed structure, retention wall 64 is immediately positioned to resist "bounce back" from cable tie 20 abruptly contacting stop 50. Thus, even at high delivery speeds, effective control of "bounce back" can be achieved because there is no moving structure that needs time to be adequately positioned. Additionally, when the biased cable tie head retainer assembly 40 is provided opposite insert 60, a more positive engagement "bounce back" resistive structure is achieved as the cable tie head can be supported on both top and bottom rear surfaces by contact with retention walls 64 and 48. Moreover, even if the biased retainer assembly 40 is slow to respond after passage of cable tie head 20 thereby, the fixed cable tie guide channel mechanism 60 formed by the insert can serve as a back-up or redundant mechanism to prevent jams or misfeeds.

In an exemplary embodiment, retention wall 64 is spaced from stop 50 at a position that restrains rearward movement so that the slot in cable tie head 20 remains positioned in line with opening 55 in the tool (FIGS. 4-5). This may be at the distal end of channel 30, or may extend slightly inward or outward therefrom.

Figure 6:
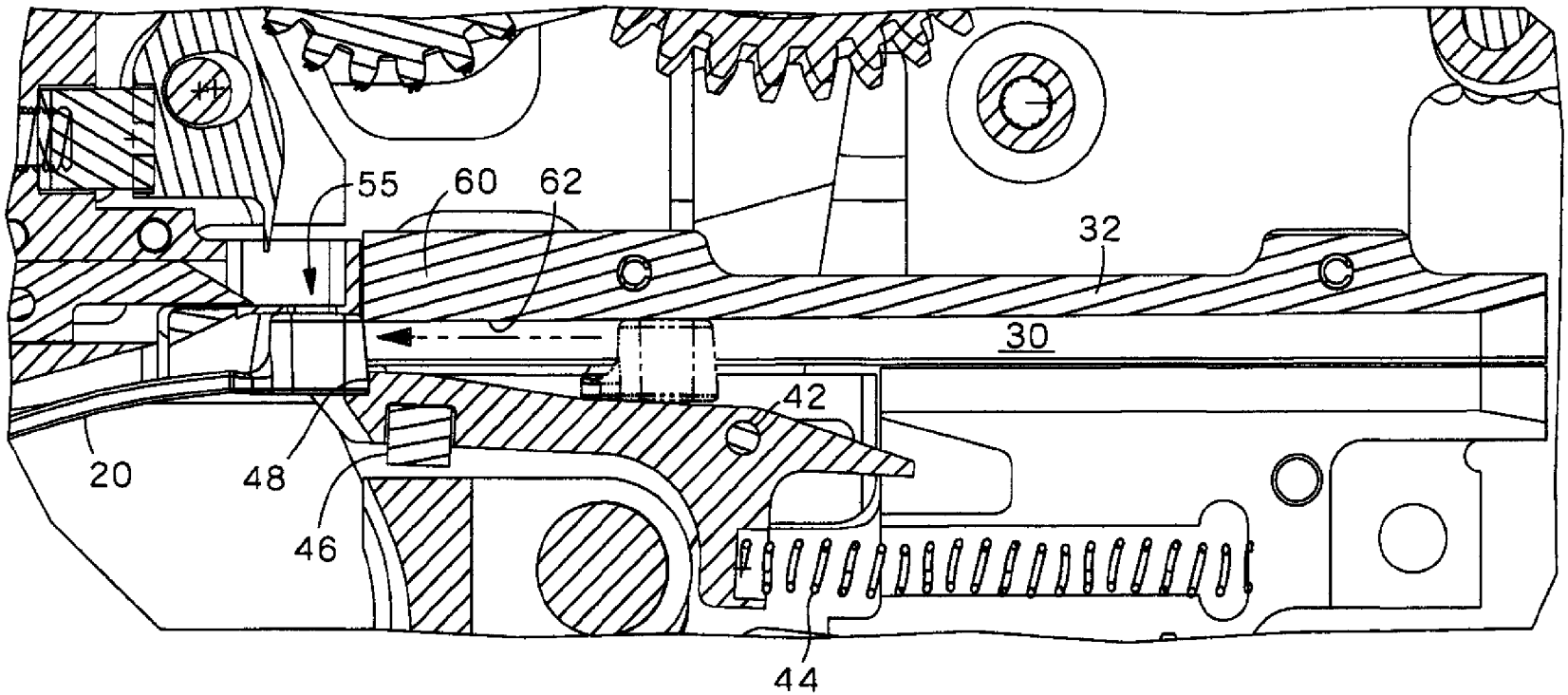
FIG. 6 is a partial cross-sectional view of a second embodiment of a tool.
Figure 7:
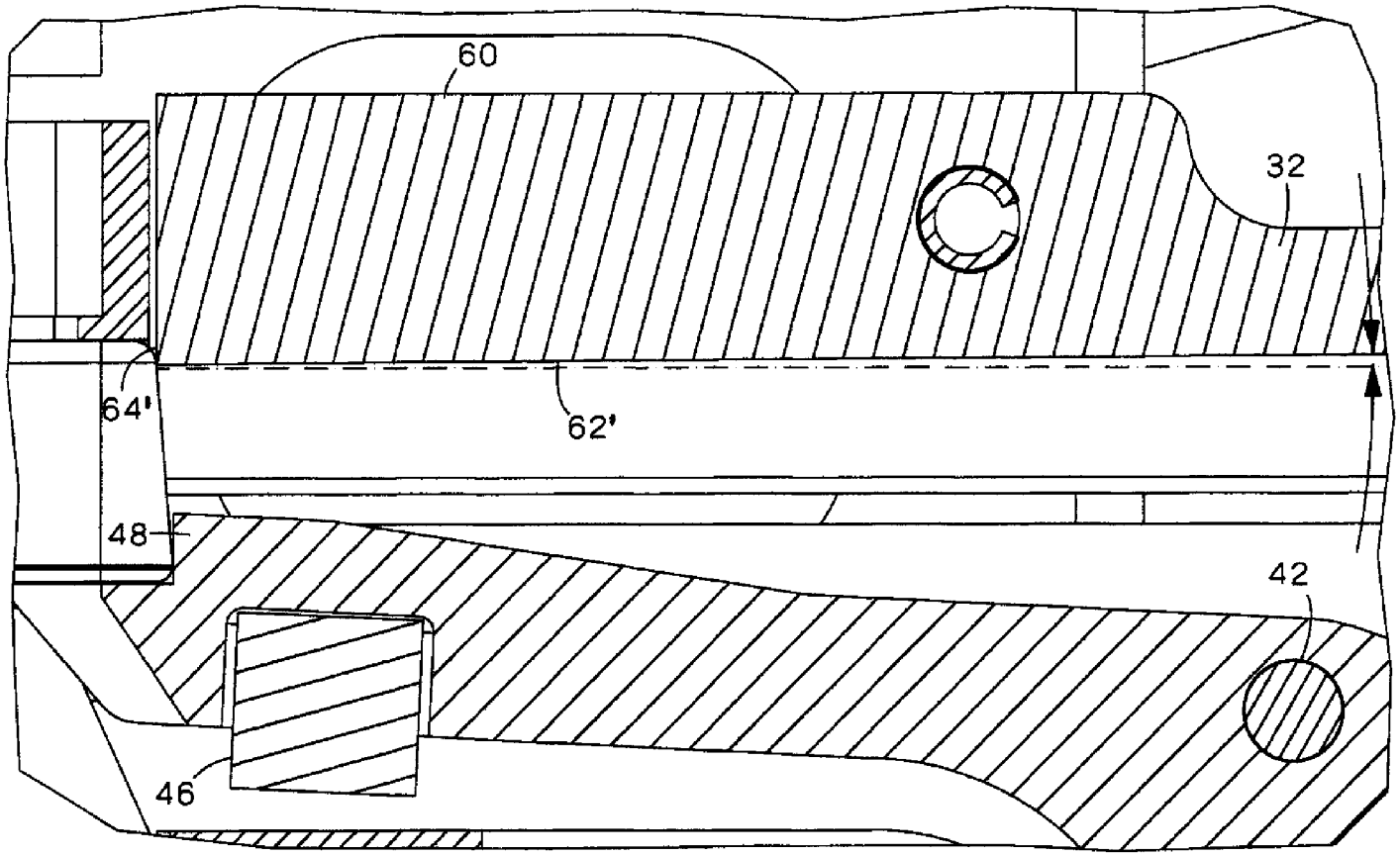
FIG. 7 is an enlarged portion of the cable tie tool of FIG. 6.

A further embodiment is shown in FIGS. 6-7 and is similar to that described in FIGS. 4-5, but integrally forms the guide channel mechanism 60 as a fixed part of guide channel 30. FIG. 6 shows the guide channel mechanism 60 with the cable tie, showing capture of both the top and bottom edges of the cable tie head. FIG. 7 shows an enlarged view illustrating the positive engagement of the mechanism with both top and bottom edges of the cable tie head. In this embodiment, top wall 32 of guide channel 30 is modified to have its distal end include a ramped surface 62' (better shown in FIG. 7) and a substantially perpendicular retention wall surface 64' as illustrated. Other than this change, operation remains as in the previous embodiment.

While the particular embodiments of the present invention have been shown and described, it will be obvious to those skilled in the art that changes and modifications may be made without departing from the invention in its broader aspects. The matter set forth in the forgoing description and accompanying drawings is offered by way of illustration only and not as a limitation. The actual scope of the invention is intended to be defined in the following claims when viewed in their proper perspective based on the prior art.

The invention claimed is:

1. An automatic cable tie installation tool for fastening an individual cable tie around a bundle of wires, comprising:

a tool jaw assembly;

a guide channel having a top wall and a lower wall, wherein the guide channel receives a supply of individual cable ties at a cable tie receiving end and guides the cable ties individually to a distal end of the guide channel at the tool jaw assembly;

a stop located in the tool to limit forward travel of the cable tie and position the cable tie at a cable tie bundling position where it can be fastened;

a fixed cable tie guide channel mechanism located along the top wall at the distal end of the guide channel, the cable tie guide channel mechanism controls forward movement of the cable tie through the guide channel and restricts rearward movement of the cable tie back into the guide channel;

wherein the cable tie guide channel mechanism includes a fixed ramp surface that forms an interior surface of the guide channel that ramps inward towards the distal end of the guide channel to restrict a guide channel height at the distal end, and a retention wall oriented substantially perpendicular to the guide channel, the retention wall being located at the distal end of the ramp surface and sized to engage a rear surface of the cable tie to restrict rearward movement of the cable tie back into the guide channel, and wherein the retention wall is located at the distal end of the guide channel.

2. The automatic cable tie installation tool according to claim 1, wherein the fixed cable tie guide channel mechanism forms a guide channel wall on a side opposite the tool jaw assembly.

3. The automatic cable tie installation tool according to claim 1, further comprising a biased head retainer assembly on a guide channel wall opposite the guide channel mechanism.

4. The automatic cable tie installation tool according to claim 3, wherein the biased head retainer assembly includes a retractable main body pivotally attached for movement toward and away from the guide channel about a pivot pin and biased by a spring, the retractable main body including a second retention wall substantially perpendicular to the guide channel sized to engage a rear surface of the cable tie to restrict rearward movement of the cable tie back into the guide channel.

5. The automatic cable tie installation tool according to claim 4, wherein the biased head retainer assembly is provided on a bottom wall of the guide channel, the retention wall of the biased head retainer assembly being engageable with a bottom rear surface of the cable tie and the retention wall of the guide channel mechanism being engageable with a top rear surface of the cable tie.

6. The automatic cable tie installation tool according to claim 1, wherein the guide channel mechanism is an insert fixed to the distal end of the guide channel.

7. The automatic cable tie installation tool according to claim 1, wherein the guide channel mechanism forms an integral part of the guide channel.

8. An automatic cable tie installation system for fastening an individual cable tie around a bundle of wires, comprising:

a cable tie dispenser that receives a supply of cable ties;

a transfer tube connected to the cable tie dispenser that receives the cable ties; and a cable tie installation tool that receives cable ties from the transfer tube, the tool including, a tool jaw assembly;

a guide channel having a top wall and a lower wall, wherein the guide channel receives a supply of individual cable ties at a cable tie receiving end and guides the cable ties individually to a distal end of the guide channel at the tool jaw assembly;

a stop located in the tool to limit forward travel of the cable tie and position the cable tie at a cable tie bundling position where it can be fastened; and a fixed cable tie guide channel mechanism located along the top wall at the distal end of the guide channel, the cable tie guide channel mechanism controls forward movement of the cable tie through the guide channel and restricts rearward movement of the cable tie back into the guide channel, wherein the cable tie guide channel mechanism includes a fixed ramp surface that forms an interior surface of the guide channel that ramps inward towards the distal end of the guide channel to restrict a guide channel height at the distal end, and a retention wall oriented substantially perpendicular to the guide channel, the retention wall being located at the distal end of the ramp surface and sized to engage a rear surface of the cable tie to restrict rearward movement of the cable tie back into the guide channel, wherein the retention wall is located at the distal end of the guide channel.

9. The automatic cable tie installation system according to claim 8, wherein the fixed cable tie guide channel mechanism forms a guide channel wall on a side opposite the tool jaw assembly.

10. The automatic cable tie installation system according to claim 8, further comprising a biased head retainer assembly on a guide channel wall opposite the guide channel mechanism.

11. The automatic cable tie installation system according to claim 10, wherein the biased head retainer assembly includes a retractable main body pivotally attached for movement toward and away from the guide channel about a pivot pin and biased by a spring, the retractable main body including a second retention wall substantially perpendicular to the guide channel sized to engage a rear surface of the cable tie to restrict rearward movement of the cable tie back into the guide channel.

12. The automatic cable tie installation system according to claim 11, wherein the biased head retainer assembly is provided on a bottom wall of the guide channel, the retention wall of the biased head retainer assembly being engageable with a bottom rear surface of the cable tie and the retention wall of the guide channel mechanism being engageable with a top rear surface of the cable tie.

13. The automatic cable tie installation system according to claim 8, wherein the guide channel mechanism is an insert fixed to the distal end of the guide channel.

14. The automatic cable tie installation system according to claim 8, wherein the guide channel mechanism forms an integral part of the guide channel.

15. An automatic cable tie installation tool for fastening an individual cable tie around a bundle of wires, comprising:

a tool jaw assembly;

a guide channel having a top wall and a lower wall, wherein the guide channel receives a supply of individual cable ties at a cable tie receiving end and guides the cable ties individually to a distal end of the guide channel at the tool jaw assembly;

a stop located in the tool to limit forward travel of the cable tie and position the cable tie at a cable tie bundling position where it can be fastened;

a fixed cable tie guide channel mechanism located along the top wall at the distal end of the guide channel, the cable tie guide channel mechanism controls forward movement of the cable tie through the guide channel and restricts rearward movement of the cable tie back into the guide channel, the fixed cable tie guide channel mechanism forming a guide channel wall on a side opposite the tool jaw assembly; and a biased head retainer assembly on a guide channel wall opposite the guide channel mechanism, wherein the cable tie guide channel mechanism includes a fixed ramp surface that forms an interior surface of the guide channel that ramps inward towards the distal end of the guide channel to restrict a guide channel height at the distal end, and a retention wall oriented substantially perpendicular to the guide channel, the retention wall being located at the distal end of the ramp surface and sized to engage a rear surface of the cable tie to restrict rearward movement of the cable tie back into the guide channel, wherein the retention wall is located at the distal end of the guide channel.

16. The automatic cable tie installation system according to claim 15, wherein the guide channel mechanism is an insert fixed to the distal end of the guide channel.

17. The automatic cable tie installation tool according to claim 15, wherein the guide channel mechanism forms an integral part of the guide channel.

* * * * *

UNITED STATES PATENT AND TRADEMARK OFFICE

CERTIFICATE OF CORRECTION

PATENT NO. : 8,528,603 B2
APPLICATION NO. : 11/859475
DATED : September 10, 2013
INVENTOR(S) : Jonathan A. DeMik It is certified that error appears in the above-identified patent and that said Letters Patent is hereby corrected as shown below:

In the specification

Column 3, line 28 which reads "cable tie passageway in tube 20..." should read "cable tie passageway in tube 22...."

Column 3, line 61 which reads "...due to tile high speeds..." should read "...due to the high speeds...."

Column 3, line 66 which reads "...becomes caught oil the..." should read "becomes caught on the...."

Column 4, line 13 which reads "60 on tile top of the..." should read "60 on the top of the...."

Column 4, line 29 which reads "...interference. while retention wall..." should read "...interference, while retention wall...."

Column 4, line 50 which reads "...30 opposite tile jaws." should read "...30 opposite the jaws."

Signed and Sealed this
Twenty-first Day of April, 2015

Michelle K. Lee

Michelle K. Lee
*Director of the United States Patent and Trademark Office*